US009090390B2

(12) United States Patent
Walling et al.

(10) Patent No.: US 9,090,390 B2
(45) Date of Patent: Jul. 28, 2015

(54) PRODUCT DISPENSING SYSTEM

(75) Inventors: Bradford J. Walling, Chesterfield, VA (US); John Gelardi, Midlothian, VA (US); Aaron L. Bates, Moseley, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 12/891,391

(22) Filed: Sep. 27, 2010

(65) Prior Publication Data

US 2012/0074164 A1 Mar. 29, 2012

(51) Int. Cl.

| | |
|---|---|
| ***B65D 83/00*** | (2006.01) |
| ***B65D 71/36*** | (2006.01) |
| ***A47F 1/08*** | (2006.01) |
| ***B65D 5/72*** | (2006.01) |

(52) U.S. Cl.

CPC ..... *B65D 71/36* (2013.01); *A47F 1/087* (2013.01); *B65D 5/725* (2013.01); *B65D 2571/0066* (2013.01); *B65D 2571/00141* (2013.01); *B65D 2571/00617* (2013.01); *B65D 2571/00728* (2013.01)

(58) Field of Classification Search

CPC ..... A47F 1/087; A47F 1/08
USPC ..... 221/282, 30–32
See application file for complete search history.

(56) References Cited

U.S. PATENT DOCUMENTS

| | | | | |
|---|---|---|---|---|
| 902,347 | A | | 10/1908 | Tillinghast |
| 1,291,420 | A | | 1/1919 | Cough |
| 1,383,318 | A | | 7/1921 | McCormick |
| 1,393,964 | A | | 10/1921 | Potts et al. |
| 1,753,957 | A | | 4/1930 | Washburn |
| 1,824,937 | A | | 9/1931 | Trouth |
| 1,898,056 | A | | 2/1933 | Johnson |
| 1,919,907 | A | | 7/1933 | Robinson |
| 1,932,225 | A | | 10/1933 | Minter |
| 1,941,458 | A | * | 1/1934 | Bens ..... 206/239 |
| 1,985,739 | A | | 12/1934 | Murray |
| 2,078,599 | A | | 4/1937 | McCauley |
| 2,110,194 | A | | 3/1938 | Blier |
| 2,263,353 | A | * | 11/1941 | Eidam ..... 30/2 |
| 2,291,187 | A | | 7/1942 | Johnson |
| 2,382,191 | A | | 7/1944 | Weichselbaum |
| 2,536,421 | A | | 2/1951 | Burhans |

(Continued)

FOREIGN PATENT DOCUMENTS

| | | |
|---|---|---|
| GB | 2190906 | 12/1987 |
| GB | 2303624 | 2/1997 |

(Continued)

OTHER PUBLICATIONS

International Search Report and Written Opinion issued in PCT/US2010/057020 (Mar. 8, 2011).

(Continued)

*Primary Examiner* — Michael K Collins
(74) *Attorney, Agent, or Firm* — MeadWestvaco Intellectual Property Group

(57) ABSTRACT

A product dispensing system including a container having a plurality of walls that define an internal volume and an opening into the internal volume, and a dispenser including a frame configured to support the container and a catch element connected to the frame, the catch element being positioned to engage the opening when the container is loaded onto the frame.

17 Claims, 6 Drawing Sheets

(56) References Cited

U.S. PATENT DOCUMENTS

| | | | | |
|---|---|---|---|---|
| 2,573,381 | A | 10/1951 | Arnold | |
| 2,574,087 | A | 11/1951 | Burhans | |
| 2,595,122 | A | 4/1952 | Burhans | |
| 2,784,871 | A | 3/1957 | Gabrielsen | |
| 2,795,845 | A | 6/1957 | Shimer | |
| 2,818,978 | A | 1/1958 | Post | |
| 2,826,471 | A | 3/1958 | Fonda | |
| 2,831,591 | A | 4/1958 | Morton | |
| 2,888,145 | A | 5/1959 | Knott et al. | |
| 2,915,932 | A | 12/1959 | Gross | |
| 2,919,488 | A | 1/1960 | Brownlee | |
| 2,996,344 | A | 8/1961 | Garman | |
| 3,018,149 | A | 1/1962 | Parker | |
| 3,055,293 | A | 9/1962 | Lariccia | |
| 3,066,827 | A | 12/1962 | Pryor | |
| 3,137,068 | A | 6/1964 | Quigley | |
| D198,888 | S | 8/1964 | Heselov | |
| 3,178,242 | A | 4/1965 | Ellis et al. | |
| 3,184,104 | A | 5/1965 | De Domenico et al. | |
| 3,203,554 | A | 8/1965 | Pendergrast et al. | |
| 3,204,335 | A | 9/1965 | Hughes | |
| 3,288,544 | A | 11/1966 | Knecht | |
| 3,300,115 | A | 1/1967 | Schauer | |
| 3,304,141 | A | 2/1967 | Rogers | |
| 3,318,455 | A | 5/1967 | Takahashi | |
| 3,335,940 | A | 8/1967 | Dykes | |
| 3,340,790 | A | 9/1967 | Simjian | |
| 3,348,738 | A | 10/1967 | Hertlein | |
| 3,392,901 | A | 7/1968 | Krzyzanowski | |
| 3,393,808 | A | 7/1968 | Chirchill | |
| 3,501,016 | A | 3/1970 | Eaton | |
| 3,763,557 | A | 10/1973 | Sewell | |
| 3,784,022 | A | 1/1974 | Beesley, Jr. | |
| 3,922,778 | A | 12/1975 | Aalpoel | |
| 3,923,159 | A | 12/1975 | Taylor et al. | |
| 3,972,454 | A | 8/1976 | Croley | |
| 4,105,126 | A | 8/1978 | Deffner et al. | |
| 4,205,440 | A * | 6/1980 | Morgan | 30/287 |
| 4,260,072 | A | 4/1981 | Quasarano | |
| 4,382,526 | A | 5/1983 | Stone | |
| 4,396,143 | A | 8/1983 | Killy | |
| 4,435,026 | A | 3/1984 | Johnson | |
| 4,467,524 | A | 8/1984 | Ruff et al. | |
| 4,576,272 | A | 3/1986 | Morgan, Jr. | |
| 4,598,828 | A | 7/1986 | Young et al. | |
| 4,729,480 | A | 3/1988 | Groover et al. | |
| 4,744,489 | A | 5/1988 | Binder et al. | |
| 4,834,263 | A | 5/1989 | Becze | |
| 4,869,395 | A | 9/1989 | Rubbmark | |
| 4,911,309 | A | 3/1990 | Stefan | |
| 4,915,571 | A | 4/1990 | Toshihiko et al. | |
| 4,923,070 | A | 5/1990 | Jackle et al. | |
| 4,997,106 | A | 3/1991 | Rockola | |
| 4,998,628 | A * | 3/1991 | Ross | 211/59.2 |
| 5,033,348 | A | 7/1991 | Walsh | |
| 5,080,256 | A | 1/1992 | Rockola | |
| 5,101,703 | A | 4/1992 | Tanaka et al. | |
| 5,167,345 | A | 12/1992 | Bleeker | |
| 5,251,972 | A * | 10/1993 | Zurawin | 312/118 |
| 5,289,943 | A | 3/1994 | Powell | |
| 5,314,078 | A | 5/1994 | Morikiyo et al. | |
| 5,328,258 | A | 7/1994 | Scalise | |
| 5,356,033 | A | 10/1994 | Delaney | |
| 5,372,278 | A | 12/1994 | Leight | |
| 5,390,821 | A * | 2/1995 | Markel | 221/194 |
| 5,396,997 | A | 3/1995 | Johnson | |
| D363,174 | S | 10/1995 | Fletcher, Sr. | |
| 5,462,198 | A | 10/1995 | Schwimmer | |
| 5,529,207 | A | 6/1996 | Oden et al. | |
| 5,638,988 | A | 6/1997 | Rogers | |
| 5,685,664 | A | 11/1997 | Parham et al. | |
| 5,740,610 | A | 4/1998 | Ayer et al. | |
| 5,788,117 | A | 8/1998 | Zimmanck | |
| 5,791,048 | A | 8/1998 | Bodnar et al. | |
| 5,836,478 | A | 11/1998 | Weiss | |
| 5,878,862 | A | 3/1999 | Dewsnap | |
| 5,894,942 | A | 4/1999 | Miyashita et al. | |
| 5,992,286 | A | 11/1999 | Boole | |
| 5,992,652 | A | 11/1999 | Springs | |
| 6,186,345 | B1 | 2/2001 | Robertson | |
| 6,199,720 | B1 | 3/2001 | Rudick et al. | |
| 6,206,237 | B1 | 3/2001 | Dillon et al. | |
| 6,253,930 | B1 | 7/2001 | Freidus et al. | |
| 6,267,258 | B1 | 7/2001 | Wilkerson et al. | |
| 6,393,799 | B2 | 5/2002 | Jenkins et al. | |
| 6,637,604 | B1 | 10/2003 | Jay | |
| 6,802,433 | B2 | 10/2004 | Leykin | |
| 6,991,116 | B2 * | 1/2006 | Johnson et al. | 211/59.2 |
| 7,207,447 | B2 | 4/2007 | Medcalf et al. | |
| 7,303,095 | B2 | 12/2007 | Nagelski et al. | |
| 7,546,973 | B2 | 6/2009 | Budz et al. | |
| 7,584,854 | B2 | 9/2009 | Chandaria | |
| D604,972 | S | 12/2009 | Henry et al. | |
| 7,665,618 | B2 | 2/2010 | Jay et al. | |
| 7,681,745 | B2 | 3/2010 | Richter | |
| 7,810,672 | B1 | 10/2010 | Mason et al. | |
| 7,823,733 | B2 | 11/2010 | Futori | |
| 7,850,015 | B1 | 12/2010 | Mason | |
| 7,913,860 | B2 | 3/2011 | Merl | |
| 7,918,365 | B2 | 4/2011 | White et al. | |
| 7,922,437 | B1 * | 4/2011 | Loftin et al. | 414/412 |
| 7,992,747 | B2 * | 8/2011 | Bauer | 221/197 |
| 8,028,855 | B2 | 10/2011 | White et al. | |
| 8,322,543 | B2 * | 12/2012 | Gelardi et al. | 211/59.2 |
| 8,448,815 | B2 * | 5/2013 | Sholl et al. | 221/6 |
| 2001/0053221 | A1 | 12/2001 | Takeda | |
| 2002/0043509 | A1 | 4/2002 | Lajeunesse et al. | |
| 2004/0011751 | A1 | 1/2004 | Johnson et al. | |
| 2004/0262326 | A1 | 12/2004 | Christensen | |
| 2005/0127015 | A1 | 6/2005 | Medcalf et al. | |
| 2005/0207877 | A1 | 9/2005 | Haverdink et al. | |
| 2006/0081692 | A1 | 4/2006 | Stewart et al. | |
| 2006/0237384 | A1 | 10/2006 | Neumann et al. | |
| 2006/0278591 | A1 | 12/2006 | Tippets et al. | |
| 2008/0245813 | A1 | 10/2008 | Johnson et al. | |
| 2009/0212066 | A1 * | 8/2009 | Bauer | 221/281 |
| 2009/0266776 | A1 | 10/2009 | Johnson | |
| 2010/0032391 | A1 | 2/2010 | Schneider et al. | |
| 2011/0121010 | A1 | 5/2011 | Loftin et al. | |
| 2011/0121011 | A1 | 5/2011 | Gelardi et al. | |
| 2012/0018391 | A1 * | 1/2012 | Gelardi et al. | 211/59.2 |
| 2012/0074016 | A1 * | 3/2012 | Gelardi et al. | 206/459.5 |
| 2012/0074164 | A1 * | 3/2012 | Walling et al. | 221/282 |

FOREIGN PATENT DOCUMENTS

| | | | |
|---|---|---|---|
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |

(56) References Cited

FOREIGN PATENT DOCUMENTS

| | | | |
|---|---|---|---|
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 2004113808 | | 12/2004 |
| WO | WO 2009138538 | | 11/2009 |

OTHER PUBLICATIONS

International Search Report and Written Opinion issued in PCT/US2010/057221 (Mar. 4, 2011).

International Preliminary Report on Patentability, PCT/US2011/051550 (2013).

* cited by examiner

PRODUCT DISPENSING SYSTEM

FIELD

This application relates to the dispensing of products from packaging containers and, more particularly, to product dispensers configured to cooperate with packaging containers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 filed on May 11, 2010, the entire contents of which are incorporated herein by reference, discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity.

Despite advances already made in the field, those skilled in the art continue with research and development efforts directed to apparatus and systems for dispensing products from packaging containers.

SUMMARY

In one aspect, the disclosed product dispensing system may include a container having a plurality of walls that define an internal volume and an opening into the internal volume, and a dispenser including a frame configured to support the container and a catch element connected to the frame, the catch element being positioned to engage the opening when the container is loaded onto the frame.

In another aspect, the disclosed product dispenser may include a frame having two opposed side walls and a support surface extending between the opposed side walls, the support surface having a front end and a rear end, and a catch element connected to the support surface proximate the front end of the support surface.

In yet another aspect, the disclosed product dispensing system may include a container having a plurality of walls that define an internal volume, wherein a base wall of the container defines an opening into the internal volume, and a dispenser including a frame having two opposed side walls and a support surface extending between the opposed side walls, the support surface having a front end and a rear end, and a catch element connected to the support surface proximate the front end of the support surface, wherein the container is positioned on the support surface and the catch element is engaged with the base wall of the container.

Other aspects of the disclosed product dispensing system and associated product dispenser will become apparent from the following detailed description, the accompanying drawings and the appended claims.

DETAILED DESCRIPTION

Figure 1:
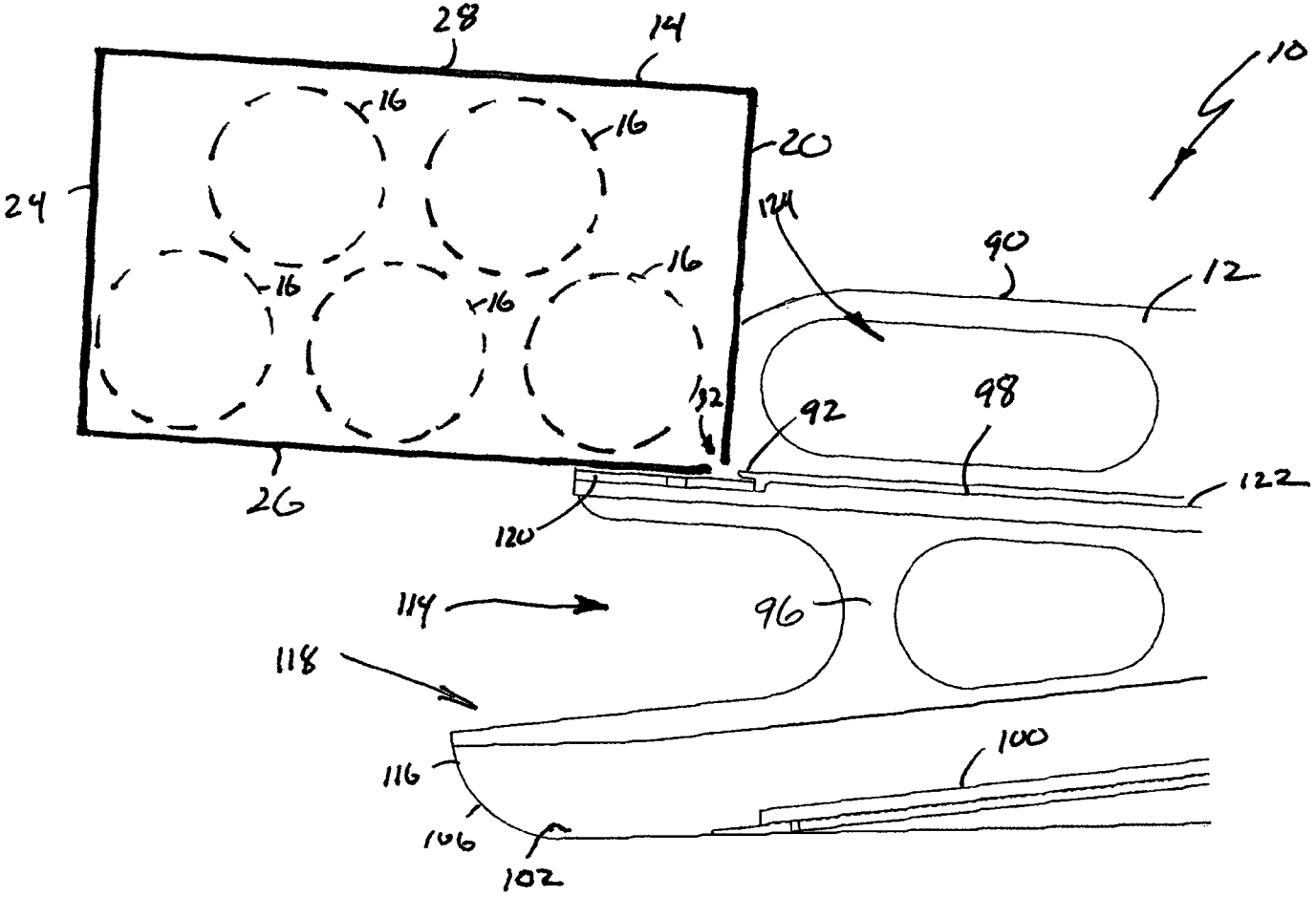
FIG. 1 is a side elevational view, in section, of one aspect of the disclosed product dispensing system, shown partially assembled.
Figure 2:
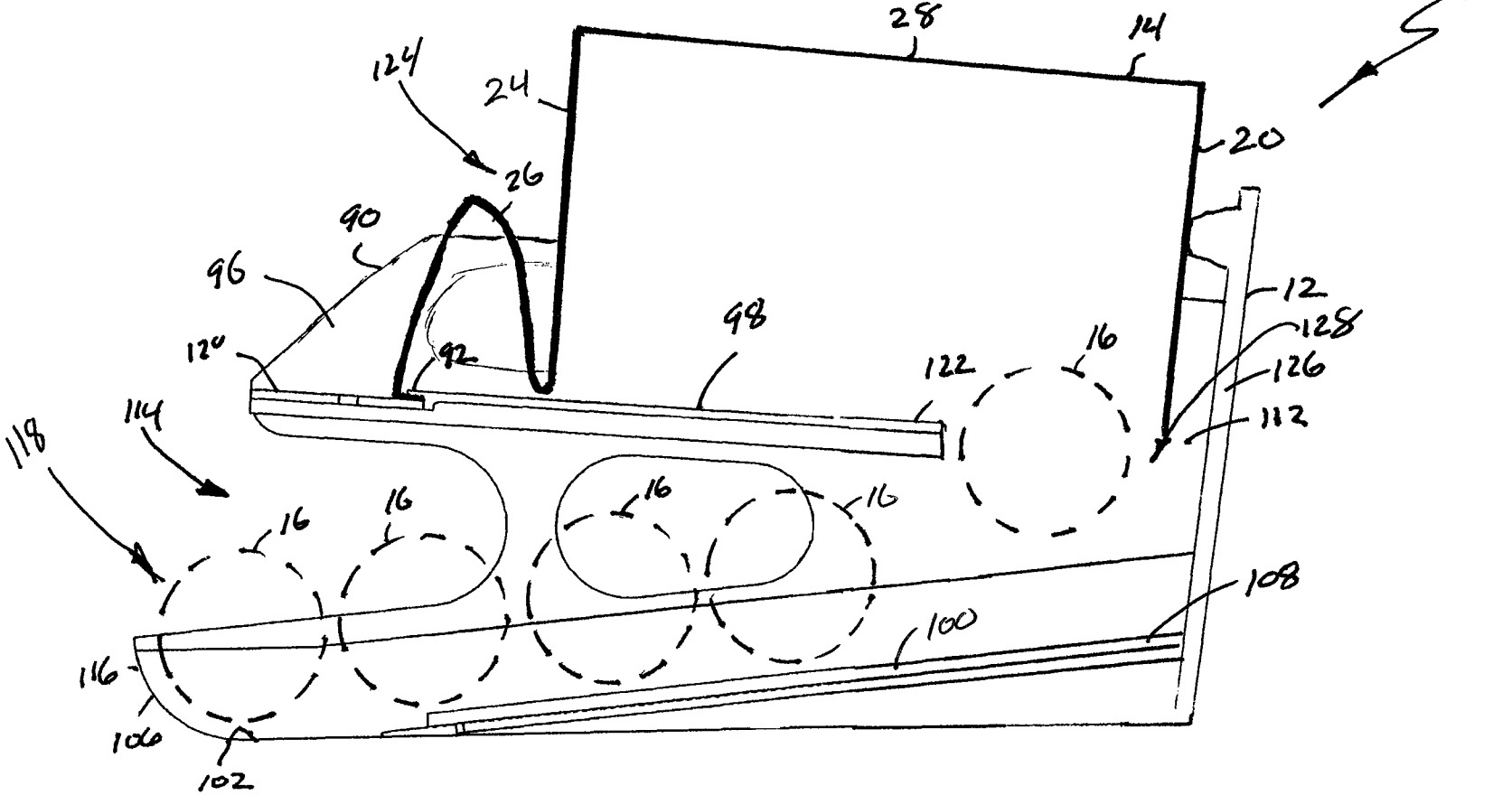
FIG. 2 is a side elevational view, in section, of the product dispensing system of FIG. 1, shown fully assembled.

Referring to FIGS. 1 and 2, one aspect of the disclosed product dispensing system, generally designated 10, may include a dispenser 12 and a container 14. The container 14 may house multiple units of product 16, such as cans (e.g., canned soup), jars (e.g., jarred sauce) or bottles (e.g., bottled soft drinks). Therefore, when the container 14 is loaded onto the dispenser 12, the dispenser 12 may engage and open the container 14 to release the products 16 from the container 14 into the dispenser 12.

Figure 5:
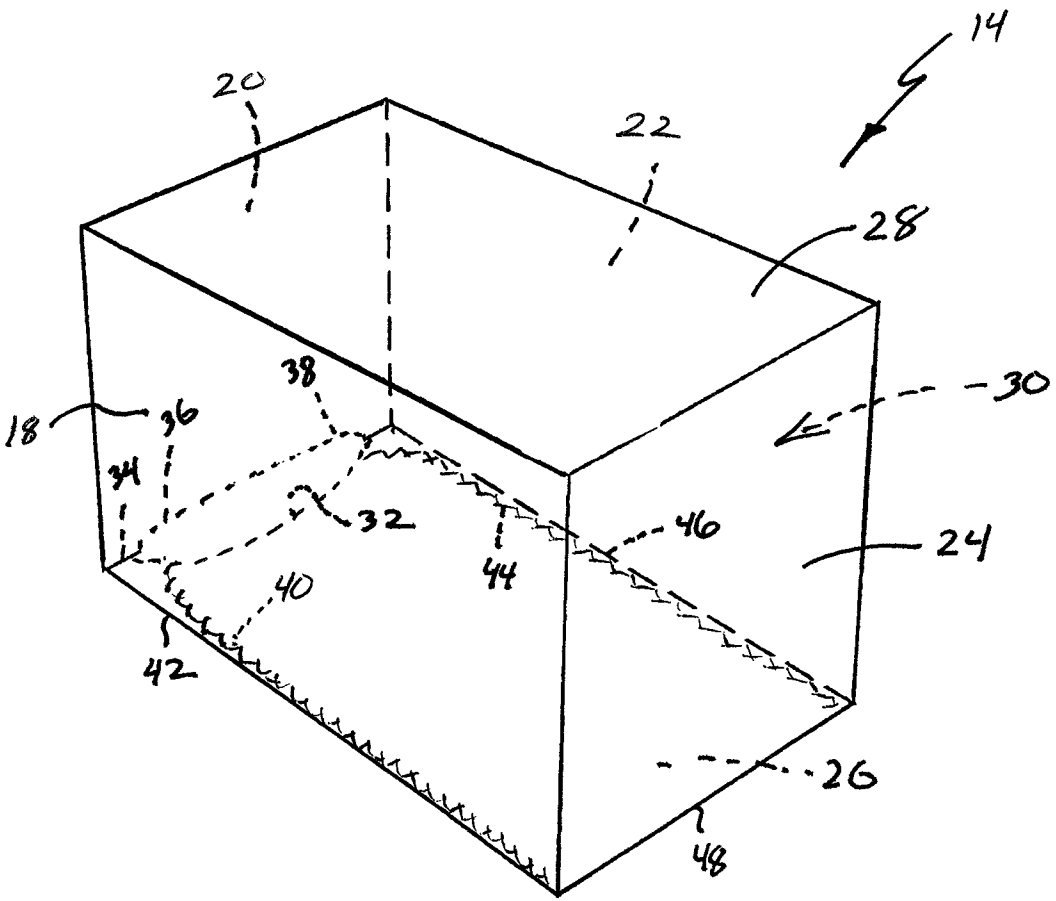
FIG. 5 is front perspective view a the container of the product dispensing system of FIG. 1.

The container 14 may be any container capable of housing products 16 and beneficially interacting with the disclosed dispenser 12. In one construction, the container 14 may be a generally rectilinear container having six walls 18, 20, 22, 24, 26, 28 that define an internal volume 30, as shown in FIG. 5. Opposed walls 24 and 20 may define the front and rear walls, respectively, of the container 14. Opposed walls 18 and 22 may define the first (e.g., left) and second (e.g., right) side walls, respectively, of the container 14. Opposed walls 22 and 26 may define the upper and base walls, respectively, of the container 14.

One or more walls 18, 20, 22, 24, 26, 28 of the container 14 may define an opening 32 into the internal volume 30 of the container 14. In one implementation, the opening 32 may be formed in the rear 20 and base 26 walls of the container 14, and may be localized along the edge 34 between the rear 20 and base 26 walls of the container 14. The opening 32 may be generally laterally oblong in shape and may include a first (e.g., left) end 36 positioned proximate (i.e., at or near) the left side wall 18 of the container 16 and a second (e.g., right) end 38 positioned proximate the right side wall 22 of the container 16.

Those skilled in the art will appreciate that the opening 32 may be positioned at various alternative locations and may have various alternative configurations, provided that the opening 32 is capable of being engaged by the dispenser 12 when the container 14 is being loaded onto the dispenser 12. As a first alternative implementation, the opening 32 may be formed entirely in the rear wall 20 of the container 14. As a second alternative implementation, the opening 32 may be formed entirely in the base wall 26 of the container 14. Other implementations are also contemplated.

A first row of perforations 40 may extend generally longitudinally from the opening 32 to proximate the front wall 24 of the container 14. For example, the first row of perforations 40 may be formed in the base wall 26 and may extend from the left end 36 of the opening 32, along the edge 42 between the left side wall 18 and the base wall 26, and to the front wall 24 of the container 14. However, those skilled in the art will appreciate that the first row of perforations 40 may alternatively be formed in the left side wall 18 or in both the base wall 26 and the left side wall 18.

A second row of perforations 44 may also extend generally longitudinally from the opening 32 to proximate the front wall 24 of the container 14. For example, the second row of perforations 44 may be formed in the base wall 26 and may extend from the right end 38 of the opening 32, along the edge 46 between the right side wall 22 and the base wall 26, and to the front wall 24 of the container 14. Like the first row of perforations 40, the second row of perforations 44 may alternatively be formed in the right side wall 22 or in both the base wall 26 and the right side wall 22.

Thus, a pulling force applied to the base wall 26 at the opening 32 may separate the base wall 26 (or at least a portion thereof) from the container 14 along the first 40 and second 44 rows of perforations. Optionally, a third row of perforations (not shown) may extend from the first row of perforations 40 to the second row of perforations 44 (e.g., along the edge 48 between the front wall 24 and the base wall 26) to allow for complete separation of the base wall 26 (or at least a portion thereof) from the container 14.

In the expression illustrated in FIG. 5, the rows of perforations 40, 44 are shown as being comprised of a series of zipper-like cuts in the container 14. However, those skilled in the art will appreciate that a wide variety of perforation types and perforation strengths (e.g., ties/teeth per inch) are known in the art, including standard perforations and micro perforations, and that variation in the type of perforations used will not constitute a departure from the scope of the present disclosure.

Figure 6:
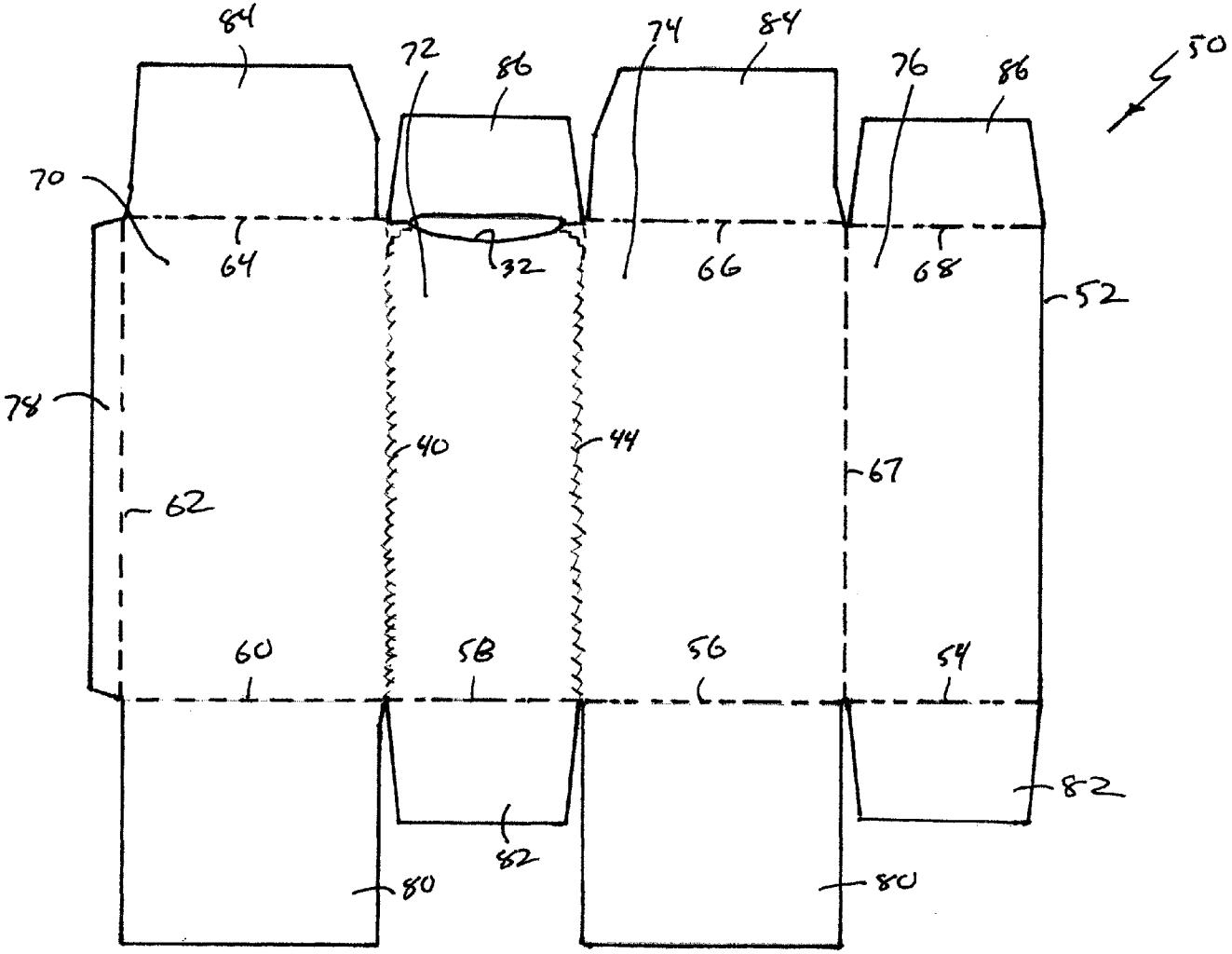
FIG. 6 is a top plan view of a container blank useful for forming the container shown in FIG. 5.

The container 14 may be formed from a container blank, such as the container blank 50 shown in FIG. 6. The container blank 50 may be pre-cut from a sheet of stock material to define an outer periphery 52 of the container blank 50. In one particular aspect, the stock material may be a paperboard-based material, such as C1S paperboard, which may have a coating (e.g., clay) on a first major surface thereof and an uncoated second major surface, or C2S paperboard, which may have a coating (e.g., clay) on both major surfaces thereof. Optionally, at least one major surface of the container blank 50 may be marked with various indicia, such as printed text and graphics.

The container blank 50 may include the opening 32, the first 40 and second 44 rows of perforations and a plurality of pre-formed fold lines 54, 56, 58, 60, 62, 64, 66, 67, 68 that define wall panels 70, 72, 74, 76, a sealing panel 78, first major 80 and minor 82 end flaps and second major 84 and minor 86 end flaps. Specifically, wall panel 70 may be defined by fold lines 60, 62, 64 and the first row of perforations 40, and may form the left side wall 18 of the assembled container 14 (FIG. 5). Wall panel 72 may be defined by fold line 58, the first 40 and second 44 rows of perforations and the opening 32, and may form the base wall 26 of the assembled container 14. Wall panel 74 may be defined by fold lines 56, 66, 67 and the second row of perforations 44, and may form the right side wall 22 of the assembled container 14. Wall panel 76 may be defined by fold lines 54, 67, 68 and the periphery 52 of the blank 50, and may form the upper wall 28 of the assembled container 14. The sealing panel 78 may be defined by fold line 62 and the periphery 52 of the blank 50, and may be sealed to wall panel 76 during assembly of the container 14. The first major 80 and minor 82 end flaps may be defined by fold lines 54, 56, 58, 60 and the periphery 52 of the blank 50, and may be assembled to form the front wall 24 of the container 14. The second major 84 and minor 86 end flaps may be defined by fold lines 64, 66, 68, 70 and the periphery 52 of the blank 50, and may be assembled to form the rear wall 20 of the container 14.

While a specific container blank 50 is shown and described, those skilled in the art will appreciate that various techniques and materials may be used to form the container 14 of the disclosed product dispensing system 10. Folded paperboard containers are only one specific and non-limiting example of the container 14 of the disclosed product dispensing system 10.

Referring now to FIGS. 1-4, the dispenser 12 may include a frame 90 for supporting the container 14 and the products 16 in a desired configuration and a catch element 92 for engaging the opening 32 in the container 14 and releasing the products 16 from the container 14 to the dispenser 12. Those skilled in the art will appreciate that the dispenser 12 may include additional components and features, such as the components and features of the dispensers disclosed in U.S. Ser. No. 12/777,444, without departing from the scope of the present disclosure.

The frame 90 may include a first side wall 94, a second side wall 96, an upper support surface 98 and a lower support surface 100. The first side wall 94 may be laterally spaced from the second side wall 96, and may be generally parallel with the second side wall 96.

The lower support surface 100 may extend longitudinally between the first 94 and second 96 side walls, and may include a front end 102 that extends to the front ends 104, 106 of the side walls 94, 96 and a rear end 108 that extends to the rear ends 110, 112 of the side walls 94, 96. Therefore, the lower support surface 100 and the side walls 94, 96 may, define a lower level 114 of the frame 90.

As best shown in FIGS. 1 and 2, the lower support surface 100 may be inclined from the front end 102 to the rear end 108 (i.e., the rear end 108 may be elevated relative to the front end 102) such that products 16 deposited proximate (i.e., at or near) the rear end 108 of the lower support surface 100 roll down to the front end 102 of the lower support surface 100 under the force of gravity. The extent of the incline of the lower support surface 100 may be dictated by, among other things, the coefficient of friction of the material used to form the frame 90 and the shape of the products 16 to be dispensed by the dispenser 12.

One or more stops 116 may be positioned proximate the front end 102 of the lower support surface 100 to prevent product 16 (FIG. 2) from rolling beyond the front end 102 of the lower support surface 100. For example, the stop 116 may be connected to (e.g., integral with) the lower support surface 100, and may be an upward curve at the front end 102 of the lower support surface 100. Therefore, the stop 116 may collect product 16 at the front end 102 of the lower support surface 100, thereby establishing a product display area 118 at the front end 102 of the lower support surface 100.

The upper support surface 98 may extend longitudinally between the first 94 and second 96 side walls, and may include a front end 120 that extends to the front ends 104, 106 of the side walls 94, 96 and a rear end 122 that extends toward, but not to, an optional rear wall 126 (FIG. 2) of the frame 90, thereby defining an upper level 124 of the frame 90. The spacing between the rear end 122 of the upper support surface 98, the rear ends 110, 112 of the side walls 94, 96 and the optional rear wall 126 (FIG. 2) may define an opening 128, which may function as a chute to allow product 16 to move from the upper level 124 to the lower level 114 of the frame 90.

As best shown in FIGS. 1 and 2, the upper support surface 98 may be declined from the front end 120 to the rear end 122 (i.e., the front end 120 may be elevated relative to the rear end 122). Therefore, product 16 supported by the upper support surface 98 may roll under the force of gravity down to the rear end 122 of the upper support surface 98, through the opening 128 and, ultimately, to the lower level 114 of the frame 90.

The catch element 92 may be position in the upper level 124 of the frame 90 and may be connected to the frame 90 between the front end 120 of the upper support surface 98 and the rear end 122 of the upper support surface 98 to engage the container 14 as the container 14 is being loaded onto the dispenser 12. It is also contemplated that the catch element 92 may be forward of the front end 120 of the upper support surface 98. The shape and position of the catch element 92 may be selected such that the catch element 92 may extend through the opening 32 in the container 14 to releasably engage (e.g., hold) the base wall 26 of the container 14 as the container 14 is loaded onto the upper support surface 98 of the frame 90 of the dispenser 12.

Thus, as shown in FIGS. 1 and 2, with the base wall 26 of the container 14 engaged with the catch element 92, particularly with the portion of the base wall 26 proximate the opening 32 engaged with the catch element 92, the base wall 26 (or at least a portion thereof) may be peeled away from the other walls 18, 20, 22, 24, 28 of the container 14 along the first and second rows of perforations 40, 44 as the container 14 is loaded onto the upper support surface 98 of the frame 90 of the dispenser 12.

Figure 3:
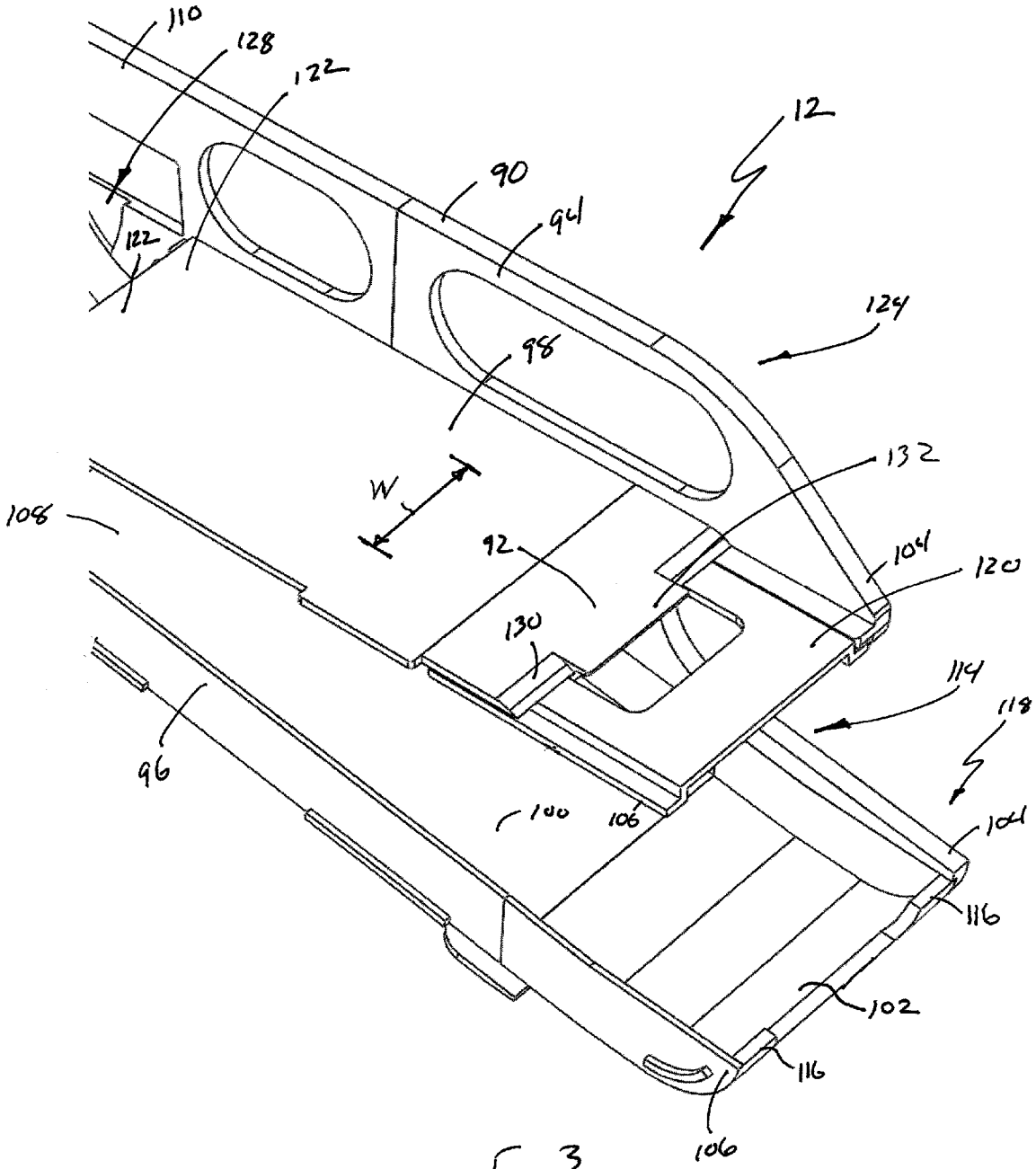
FIG. 3 is a front perspective view of a portion of the dispenser of the product dispensing system of FIG. 1.
Figure 4:
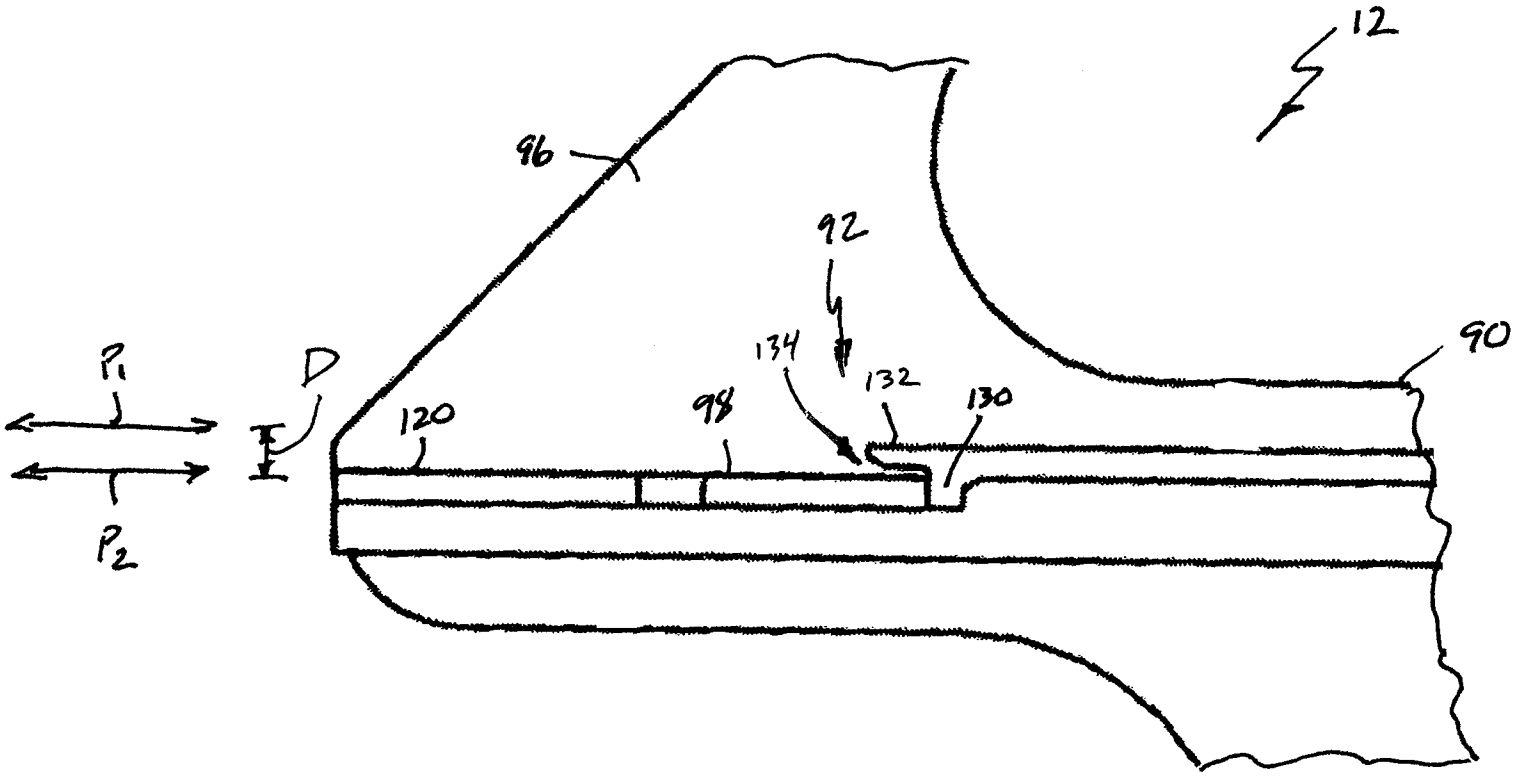
FIG. 4 is a side elevational view of another portion of the dispenser of the product dispensing system of FIG. 1.

In one particular construction, the catch element 92 may be connected to the upper support surface 98 of the frame 90 proximate the front end 120 of the upper support surface 98, and may extend laterally between the side walls 94, 96 of the frame 90, as shown in FIG. 3. As shown in FIG. 4, the catch element 92 may include a base 130 and a protrusion 132. The protrusion 132 may be finger-shaped in side view (FIG. 4), may extend forwardly (i.e., away from the rear end 122 of the upper support surface 98) from the base 130, and may have a lateral width W (FIG. 3), which may be less than the lateral spacing between the side walls 94, 96 of the frame 90. As a non-limiting example, the lateral width W of the protrusion 132 of the catch element 92 may be about 40 to about 80 percent of the lateral spacing of the side walls 94, 96 of the frame 90.

In an effort to minimize interference (e.g., drag) between the protrusion 132 of the catch element 92 and the container 14 during loading, while still allowing the catch element 92 to engage the opening 32 of the container 14, the protrusion 132 may extend through a plane $P_1$ that is generally parallel with a plane $P_2$ defined by the upper support surface 98. The plane $P_1$ of the protrusion 132 may be displaced from the plane $P_2$ of the upper support surface 98 by a distance D. The distance D may be sufficient to form a recess 134 between the protrusion 132 and the upper support surface 98 to receive the base wall 26 of the container 14. Therefore, in one expression, the distance D may be dictated by the thickness of the walls 18, 20, 22, 24, 26, 28 of the container 14.

Accordingly, when the container 14 is loaded onto the dispenser 12, the protrusion 132 of the catch element 92 may extend through the opening 32 in the container 14 such that a portion of the base wall 26 is directed into the recess 134 between the protrusion 132 and the upper support surface 98. With a portion of the base wall 26 engaged by the catch element 92, the base 130 of the catch element 92 may inhibit rearward movement of the base wall 26 (i.e., movement in the direction of the rear end 122 of the upper support surface 98) as the container 14 is being urged toward the rear end 122 of the upper support surface 98, thereby causing separation of the base wall 26 (or at least a portion thereof) from the container 14 along the first and second rows of perforations 40, 44, as shown in FIG. 2. With the base wall 26 of the container 14 separated (either partially or completely), the products 16 in the container 16 may be released from the container 14 and may roll through the dispenser 12 to the product display area 118.

While the catch element 92 is shown and described as having a finger-shaped protrusion 132, those skilled in the art will appreciate that various alternative structures may be used as the disclosed catch element 92 without departing from the scope of the present disclosure. For example, alternative catch elements 92 including various hooks, protrusions, flanges, detents and the like are contemplated as being sufficient to engage the opening 32 in the container 14 and to peel back the base wall 26 of the container 14 while the container 14 is being loaded onto the dispenser 12.

Although various aspects of the disclosed product dispensing system have been shown and described, modifications may occur to those skilled in the art upon reading the specification. The present application includes such modifications and is limited only by the scope of the claims.

What is claimed is:

1. A product dispensing system comprising:

a container comprising a plurality of walls that define an internal volume and an opening into said internal volume; and a dispenser comprising:

a frame configured to support said container; and a catch element connected to said frame, said catch element being positioned to extend through said opening and peel away a portion of said container when said container is loaded onto said frame, said catch element adapted to hold a rearmost edge of said portion and inhibit the rearward movement of said rearmost edge as said container is moved toward the rear end of said frame.

2. The product dispensing system of claim 1 further comprising a plurality of products received in said internal volume.

3. The product dispensing system of claim 1 wherein said opening extends through at least two adjacent walls of said plurality of walls.

4. The product dispensing system of claim 1 wherein said container defines at least a first row of perforations extending from said opening and a second row extending from said opening.

5. The product dispensing system of claim 1 wherein said frame comprises two opposed side walls and a support surface between said opposed side walls, said support surface having a front end and a rear end.

6. The product dispensing system of claim 5 wherein said catch element is connected to said support surface.

7. The product dispensing system of claim 5 wherein said catch element comprises a base connected to said support surface and a protrusion extending from said base.

8. The product dispensing system of claim 7 wherein said support surface defines a first plane and said protrusion defines a second plane, said first plane being generally parallel with said second plane.

9. The product dispensing system of claim 7 wherein said protrusion extends away from said rear end of said support surface.

10. The product dispensing system of claim 5 wherein said catch element is positioned proximate said front end of said support surface.

11. The product dispensing system of claim 5 wherein said front end is elevated relative to said rear end.

12. The product dispensing system of claim 5 wherein said frame further comprises a second support surface between said opposed side walls, said second support surface having a front end and a rear end, said front end of said second support surface including a stop.

13. The product dispensing system of claim 1 wherein said plurality of walls comprise a base wall, and wherein said catch element engages said base wall and at least partially separates said base wall from said container when said container is loaded onto said frame.

14. The product dispensing system of claim 13 wherein said base wall comprises a rear edge, and wherein said rear edge is retained by said catch element while said base wall is at least partially separated from said container.

15. A product dispensing system comprising:

a container comprising a plurality of walls that define an internal volume, wherein a base wall of said plurality of walls defines an opening into said internal volume; and a dispenser comprising:

a frame having a front end and a rear end, said frame comprising two opposed side walls, and an upper support surface extending between said opposed side walls, and a lower support surface positioned below said upper support surface, said lower support surface defining a product display area proximate said front end said support surface having a front end and a rear end; and a catch element connected to said upper support surface proximate said front end of said support surface, wherein said container is positioned on said upper support surface and said catch element is in retaining engagement with a portion of said base wall of said container, said catch element adapted to hold a rearmost edge of said portion and inhibit the rearward movement of said rearmost edge as said container is moved toward the rear end of said frame.

16. The product dispensing system of claim 15 wherein said catch element comprises a base connected to said upper support surface and a protrusion extending from said base toward said front end.

17. The product dispensing system of claim 16 wherein said upper support surface defines a first plane and said protrusion defines a second plane, said first plane being generally parallel with said second plane.

* * * * *